US006447139B1

(12) United States Patent
Wilkes

(10) Patent No.: US 6,447,139 B1
(45) Date of Patent: Sep. 10, 2002

(54) ILLUMINATED, DECORATIVE DOOR GUARD SYSTEM

(76) Inventor: John M. Wilkes, 208 Lucille St., Glenshaw, PA (US) 15116

( * ) Notice: Subject to any disclaimer, the term of this patent is extended or adjusted under 35 U.S.C. 154(b) by 0 days.

(21) Appl. No.: 09/860,069

(22) Filed: May 17, 2001

(51) Int. Cl.[7] ..... E05B 17/10
(52) U.S. Cl. ..... 362/100; 362/802; 362/251
(58) Field of Search ..... 362/100, 147, 362/295, 801, 802, 806, 800, 251

(56) References Cited

U.S. PATENT DOCUMENTS 2,765,396 A * 10/1956 Iverson ..... 362/203
4,310,873 A * 1/1982 Bean ..... 362/100
5,515,248 A * 5/1996 Canfield et al. ..... 362/116
5,803,581 A * 9/1998 Brockmann ..... 362/100
6,273,579 B1 * 8/2001 Holloway ..... 362/100
6,278,366 B1 * 8/2001 Fletcher et al. ..... 340/352
6,305,814 B1 * 10/2001 Giamas ..... 362/100

* cited by examiner

*Primary Examiner*—Alan Cariaso
*Assistant Examiner*—Sharon Payne
(74) *Attorney, Agent, or Firm*—John D. Gugliotta

(57) ABSTRACT

A door guard apparatus is provided having a first layer of adhesive, a middle layer providing structural rigidity and resistance to structural penetration, and a decorative outer overlay affixed to the middle layer. A knob access penetrates all the layer to allow for mounting about a doorknob. An light bulb is housed within the middle layer, and transmits illumination through a lens mounted flush with the decorative outer layer.

9 Claims, 4 Drawing Sheets

ILLUMINATED, DECORATIVE DOOR GUARD SYSTEM

BACKGROUND OF THE INVENTION

1. Field of the Invention

The present invention relates generally to escutcheons and door guards and, more particularly, to an illuminated decorative door guard system.

2. Description of the Related Art

U.S. Pat. No. 6,202,352, issued to the present invention discloses an apparatus that protects the paint and finish of a door around a door knob from dirt, grease and smudges. In its most basic form, it would be rectangular in shape with a hole for the doorknob in the middle. The invention would be placed over the doorknob, centered around the door knob and fastened into place using a series of fasteners such as screws. In this manner, any dirt, grease or other foreign materials on a persons hand would not be able to be transferred to the door and possible damage the paint or finish. It would also be capable of covering existing doors which already have been damaged. It is envisioned that he invention would be available in multiple styles and colors to fit any decor. The overall shape of the invention could be cut to produce an outline profile of a specific theme such as a cat for cat lovers or a football for sports lovers. It would be especially advantageous on bedroom doors, basement doors or outside doors that tend to get dirtier than other doors. The use of the present invention allows for the protection of door finishes around door knobs in a manner that is quick, easy and effective while producing a visual result that is complimentary to any decor.

Although the technique disclosed in the referenced patent addresses and overcomes problems theretofore extant in the art, further improvements remain desirable. For example, although the apparatus as disclosed in the reference patent provides aesthetic and protective features, such a device does not enable the door guard to become a device which could orient a person towards the door in a darkened room. Further, such a device cannot provide a low level of safety lighting that would permit occupants to maneuver during darkened conditions in a safe manner.

SUMMARY OF THE INVENTION

Briefly described according to one embodiment of the present invention, apparatus is provided that protects the paint and finish of a door around a door knob from dirt, grease and smudges while at the same time providing directional or safety illumination. In its most basic form, it would be rectangular in shape with a hole for the doorknob in the middle. The invention would be placed over the doorknob, centered around the door knob and fastened into place using a series of fasteners such as screws. In this manner, any dirt, grease or other foreign materials on a persons hand would not be able to be transferred to the door and possible damage the paint or finish. Mounted within the protective plate is an illumination means, such as light emitting diodes (LEDs) or incandescent type lamp assembly that would be capable of emitting light. The use of the present invention allows for the protection of door finishes around door knobs in a manner that is quick, easy and effective while producing a visual result that is complimentary to any decor, while at the same time providing either directional illumination (as with LED's) for orienting a person towards the door in a darkened room, or providing a low level of safety lighting (as with lamps) that would perform a night-light type function.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
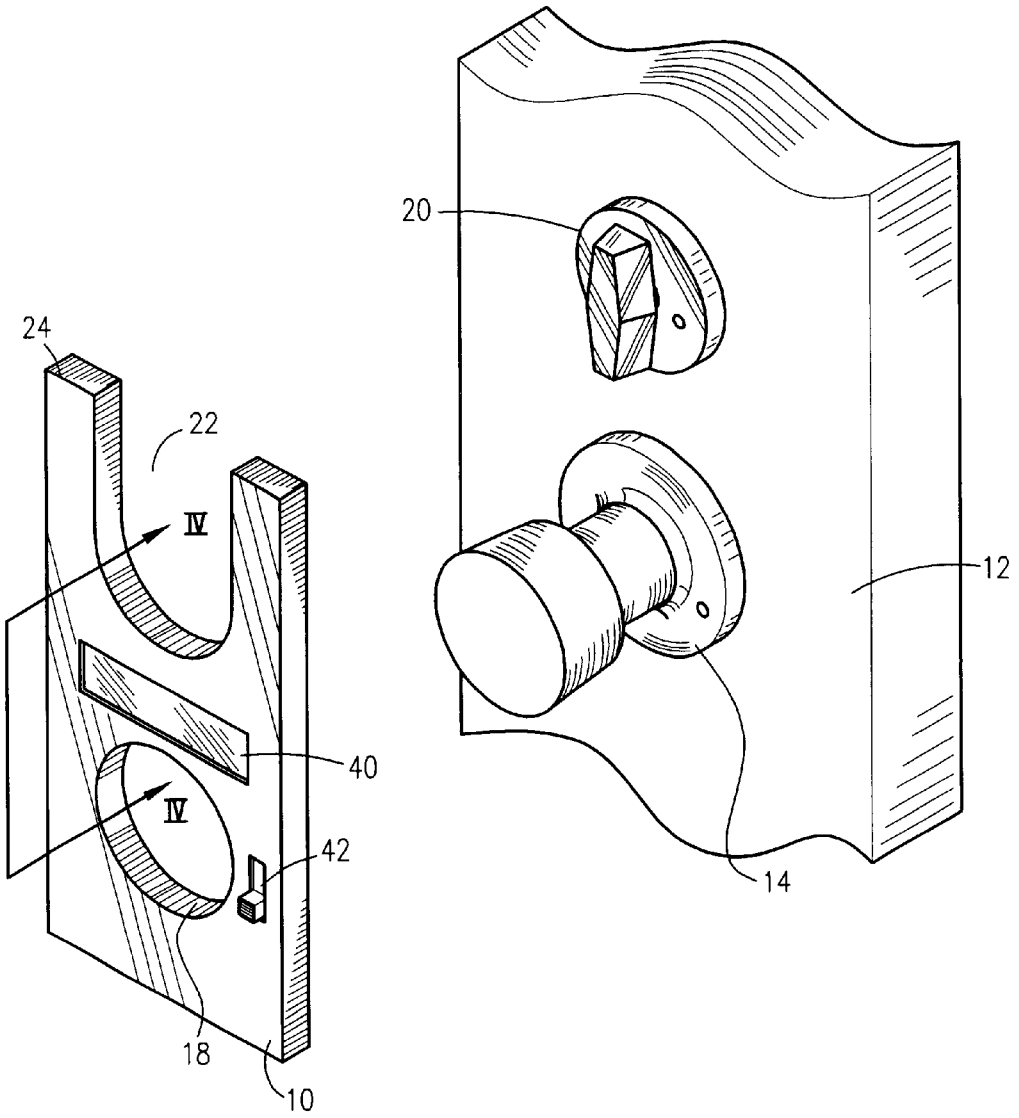
FIG. 1 is a perspective view of a door guard according to the general embodiment of the door guard system of the present invention, shown being applied to a door 12.
Figure 2:
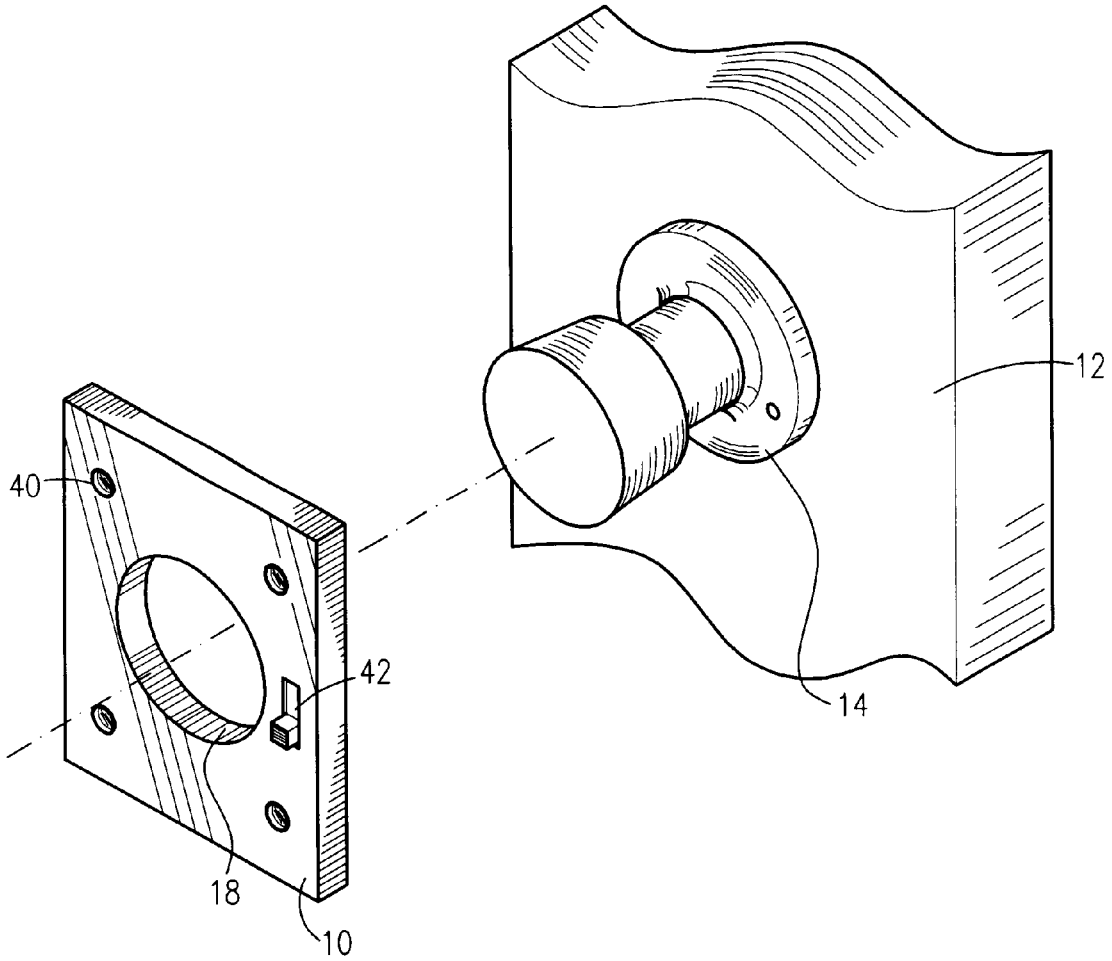
FIG. 2 is a perspective view of a door guard system according to a first alternate embodiment, shown being applied to a door 12 having a deadbolt lock 20.

Referring now to FIGS. 1–2, a door guard apparatus 10 is shown, according to the present invention, for application to a door 12 for shielding and protection of the surface area about a door knob 14. The door guard 10 forms a knob access orifice 18 near the middle and within the outer perimeter of the decorative outer plate 30. Considered as an embodiment congruent with the present teachings, for doors 12 having a deadbolt lock 20 it is envisioned that the door guard 10 will additionally form a deadbolt access indentation 22 formed along the upper edge 24 of the decorative outer plate 30. In either embodiment, an illumination means, shown generally as 40, is provided directed outward from the outer plate 30. Either a larger, individual illumination means 40, as shown in FIG. 1, or a plurality of smaller illumination means 40, as shown in FIG. 2, provide different luminous effects in order to concentrate or diffuse the light, as desired. An on/off switch 42 can control the initiation of the illumination means 40.

Figure 3:
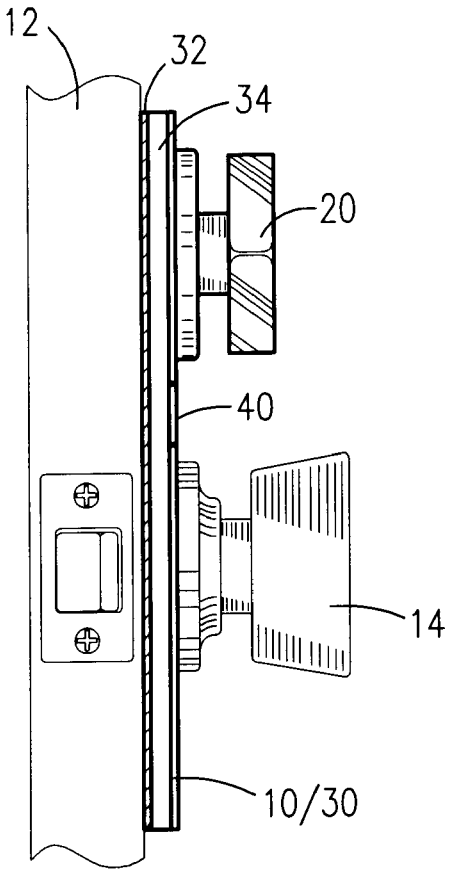
FIG. 3 is a side elevational view of a door guard system for any embodiment of the present invention.

As best shown in conjunction with FIG. 3, shown is the preferred embodiment of the present invention in which the door guard 10 is formed of a plurality of layers of material, specifically, a first layer 32, forming an attachment means for affixing to the surface of the door 12, and anticipated as being an adhesive layer for firm but removable attachment to the door 12. The adhesive is bound to a middle layer 34, forming a support substrate to provide structural rigidity and resistance to structural penetration of the door guard 10. Finally, affixed to the outer surface of the support substrate 34 is a decorative outer overlay, shown as decorative outer plate 30.

Alternate embodiments are also envisioned for practicing the attachment means 12. By way of example, and not as a limitation, one such alternate embodiment is envisioned as a pair of key shaped slots, placed vertically aligned, that allow a conventional screw fastener to penetrate the door guard 10 and physically impinge against the outer plate 30. Further, by orienting the key shaped slots alternate to one another, the user can easily install, remove, or change the door guard 10 in a manner similarly as easy as with an adhesive based attachment means. Further, by standardizing the size and locations of these key-shaped slots between decorative outer plates, interchangeability can be easily attained.

Figure 4:
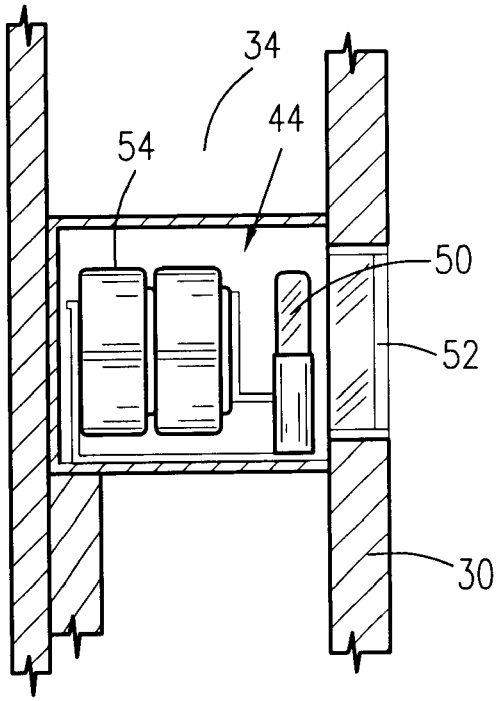
FIG. 4 is a cross sectional view taken along line IV—IV of FIG. 1.
Figure 5A:
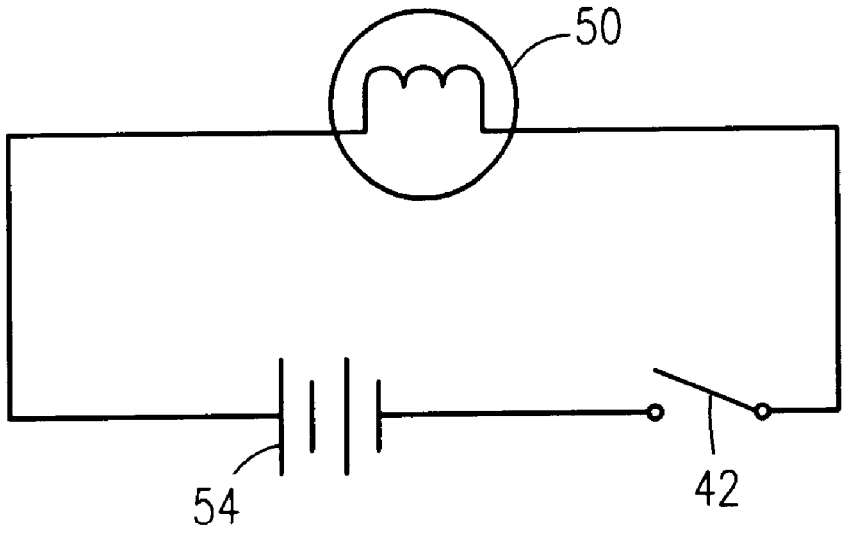
FIG. 5*a* is an electrical schematic of the operation of the preferred embodiment.

It is envisioned that the illumination means 40 be available in multiple styles and functions. For purposes of disclosure, and now by way of limitation, shown in FIGS. 4–5*a* is a specific illumination means is housed with a cavity 44 formed within the support substrate 34 layer and holds a light bulb 50 mounted behind a lens 52. The lens 52 is shown mounted flush with the outermost surface of the decorative outer surface 30. An electrical source 54, shown herein as a pair of button cell batteries in series electrically with both the bulb 50 as in electrical communication with the on/off switch 42 (not shown in FIG. 4). When turned to the "on" position, the bulb 50 will be illuminated. The lens 52 can thereby be adapted to either concentrate or diffuse the light in order to produce various luminous effects.

Figure 5B:
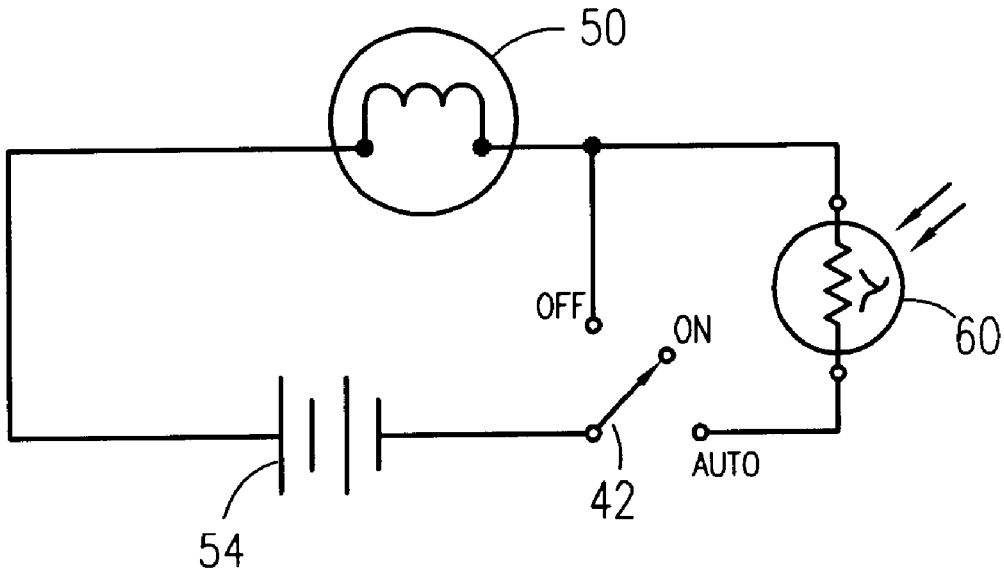
FIG. 5*b* is an electrical schematic of the operation of an alternate embodiment.

Referring in conjunction with FIG. 5*b,* an alternate embodiment is shown in which the bulb 50 can be used in one of two ways. In this embodiment, the on/off switch 42 is a three position switch, one for turning the bulb 50 on, a second for turning the bulb 50 off, and a third position for communicating with an illumination sensor 60 that will allow the bulb 50 to illuminate only when ambient light conditions are below a predetermined level. This allows the device to function as a "night-light", thereby conserving battery power during daytime operation.

2. Operation of the Preferred Embodiment

In accordance with a preferred embodiment of the present invention, as shown in the figures, the invention would be placed over the doorknob, centered around the door knob and fastened into place. In this manner, any dirt, grease or other foreign materials on a persons hand would not be able to be transferred to the door and possible damage the paint or finish. It would also be capable of covering existing doors which already have been damaged. Additionally, by turning the switch 42 to "on" or "auto", additional safety is accomplished in that individuals are provided with a safety light immediately upon awakening from sleep or entering a dark room.

As designed, a device embodying the teachings of the present invention is easily applied. The foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A door guard apparatus comprising:

a first layer, said first layer forming an attachment means for affixing to the surface of a door;

a middle layer forming a support substrate to provide structural rigidity and resistance to structural penetration and forming a receiving cavity;

a decorative outer overlay affixed to the outer surface of the support substrate and forming a translucent lens covering said receiving cavity;

illumination means housed within said receiving cavity for emitting illumination through said lens;

an on/off switch for controlling the initiation of said illumination means;

an illumination sensor that will allow said illumination means to engage when ambient light conditions are below a predetermined level, and a three-position switch, one position for turning the illumination means on, a second position for turning said illumination means off, and a third position for communicating with said illumination such as will allow said illumination means to illuminate only when ambient light conditions are below a predetermined level.

2. The door guard apparatus of claim 1, wherein said attachment means comprises an adhesive layer.

3. The door guard apparatus of claim 1, further comprising knob access orifice within the outer perimeter of said decorative outer overlay, said knob access penetrating all said layers.

4. The door guard apparatus of claim 3, further comprising a deadbolt access indentation formed along the upper edge of the decorative outer overlay.

5. The door guard apparatus of claim 1, wherein said illumination means is an individual lighting element selected from the group comprising bulbs and light emitting diodes.

6. The door guard apparatus of claim 1, wherein said illumination means comprises a plurality of light emitting diodes.

7. The door guard apparatus of claim 1, wherein said translucent lens covering has an annular form, in which the circumference of said translucent lens covering is concave relative to the plane of the door and thereby facilitating diffusion of light.

8. The door guard apparatus of claim 1, wherein said decorative outer overlay is threadably affixed to said support substrate and is adapted to different decorative outer overlays in an interchangeable fashion.

9. The door guard apparatus of claim 1, wherein said decorative outer overlay is selected from a group comprising various colors, styles and decorations, thereby permitting creative expression of user.

* * * * *